US009779927B2

(12) United States Patent
Valaskovic

(10) Patent No.: US 9,779,927 B2
(45) Date of Patent: Oct. 3, 2017

(54) SAMPLE PREPARATION AND NANOELECTROSPRAY IONIZATION MASS SPECTROMETRY

(71) Applicant: NEW OBJECTIVE, INC., Woburn, MA (US)

(72) Inventor: Gary A. Valaskovic, Cambridge, MA (US)

(73) Assignee: NEW OBJECTIVE, INC., Woburn, MA (US)

( * ) Notice: Subject to any disclaimer, the term of this patent is extended or adjusted under 35 U.S.C. 154(b) by 0 days.

(21) Appl. No.: 14/388,353

(22) PCT Filed: Apr. 18, 2013

(86) PCT No.: PCT/US2013/037138

§ 371 (c)(1),
(2) Date: Sep. 26, 2014

(87) PCT Pub. No.: WO2013/158858

PCT Pub. Date: Oct. 24, 2013

(65) Prior Publication Data

US 2015/0332907 A1 Nov. 19, 2015

Related U.S. Application Data

(60) Provisional application No. 61/635,563, filed on Apr. 19, 2012.

(51) Int. Cl.

| | |
|---|---|
| ***H01J 49/16*** | (2006.01) |
| ***H01J 49/04*** | (2006.01) |
| *B01L 3/00* | (2006.01) |

(52) U.S. Cl.
CPC ..... *H01J 49/167* (2013.01); *H01J 49/0431* (2013.01); *B01L 3/502* (2013.01)

(58) Field of Classification Search
None
See application file for complete search history.

(56) References Cited

U.S. PATENT DOCUMENTS

| | | | |
|---|---|---|---|
| 3,953,172 | A | 4/1976 | Shapiro et al. |
| 4,142,858 | A | 3/1979 | Acuff |
| 4,270,921 | A | 6/1981 | Graas |
| 4,341,635 | A | 7/1982 | Golias |

(Continued)

OTHER PUBLICATIONS

Jensen et al. "Pepetide Sequencing by Nanoelectrospray Tandem Mass Spectrometry", 2002.*

(Continued)

*Primary Examiner* — Michael Logie
(74) *Attorney, Agent, or Firm* — Norris McLaughlin & Marcus, P.A.

(57) ABSTRACT

Method for loading a sample of a target compound into a nanospray emitter tube for analysis by nanospray ionization mass spectrometry, wherein a cartridge having a fluid container, an inlet and an outlet is mounted onto a nanospray emitter tube on a nanospray emitter mount to form a nanospray emitter tube assembly, the assembly is mounted on a micro-centrifuge tube, a volume of the sample to be analyzed is loaded into the fluid container and the micro-centrifuge tube is spun on a centrifuge to transfer the sample into the nanospray emitter tube.

2 Claims, 15 Drawing Sheets

(56) References Cited

U.S. PATENT DOCUMENTS 4,413,772 A * 11/1983 Rohde ..... B04B 5/0428 494/17
4,650,784 A 3/1987 Ramsden et al.
4,774,058 A 9/1988 Mehl
4,820,276 A 4/1989 Moreno
4,958,529 A * 9/1990 Vestal ..... G01N 30/7273 250/288
5,266,193 A 11/1993 Kimura et al.
5,279,742 A 1/1994 Markell et al.
5,368,729 A 11/1994 Stefkovich et al.
5,391,298 A 2/1995 Pieper et al.
5,415,779 A 5/1995 Markell et al.
5,504,329 A 4/1996 Mann et al.
5,538,634 A 7/1996 Pfiffner et al.
5,595,653 A 1/1997 Good et al.
5,601,711 A * 2/1997 Sklar ..... B01D 25/02 210/232
5,608,217 A 3/1997 Franzen et al.
5,645,715 A * 7/1997 Coombs ..... B01D 17/00 210/136
5,882,943 A * 3/1999 Aldeen ..... B01L 3/502 210/323.2
6,478,238 B1 11/2002 Wachs et al.
6,670,607 B2 12/2003 Wood et al.
7,528,368 B2 * 5/2009 Lenke ..... C07K 1/24 250/288
8,227,750 B1 * 7/2012 Zhu ..... H01J 49/045 250/281
8,475,739 B2 * 7/2013 Holmes ..... B01L 3/0217 422/500
2002/0110493 A1 * 8/2002 Dales ..... B01F 7/167 422/534
2003/0234356 A1 * 12/2003 Konermann ..... G01N 13/00 250/281
2004/0126890 A1 * 7/2004 Gjerde ..... G01N 1/34 436/53
2004/0223880 A1 * 11/2004 Gjerde ..... G01N 1/34 422/70
2005/0118599 A1 * 6/2005 Pawliszyn ..... A61B 10/0045 435/6.12
2007/0299363 A1 * 12/2007 Wong ..... A61B 10/0038 600/562
2010/0317118 A1 * 12/2010 Masujima ..... H01J 49/167 436/63
2011/0039350 A1 * 2/2011 Franzen ..... H01J 49/0431 436/174
2013/0079599 A1 * 3/2013 Holmes ..... G06F 19/366 600/300
2014/0315237 A1 * 10/2014 Masujima ..... H01J 49/167 435/29

OTHER PUBLICATIONS

International Search Report Dated Jul. 29, 2013, Mailed Aug. 13, 2013.

* cited by examiner

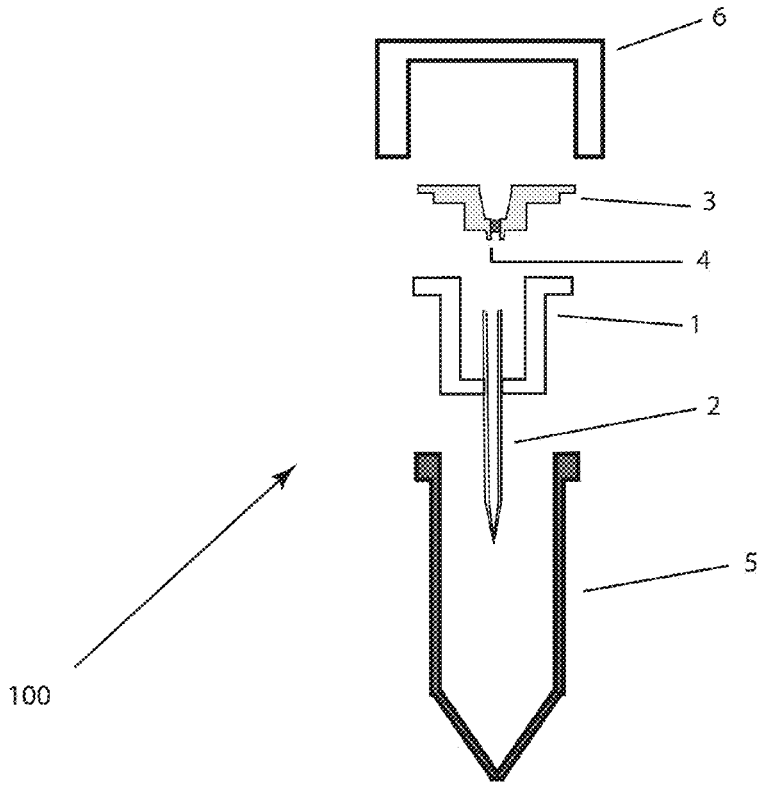
Figure 1. Expanded Sectional View of Compenents

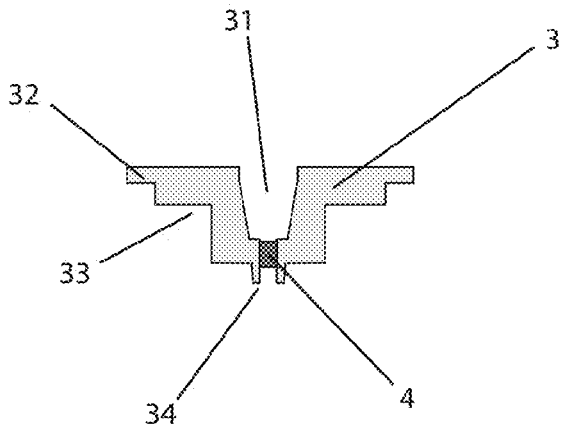
Figure 2. Detail Sectional View of Secondary Fluidic Element
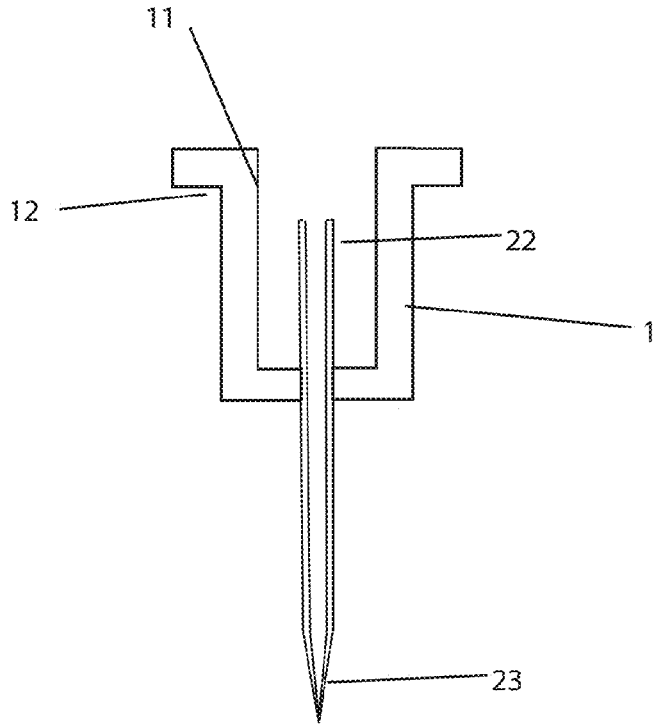
Figure 3. Detail Sectional View of Nanospray emitter mount

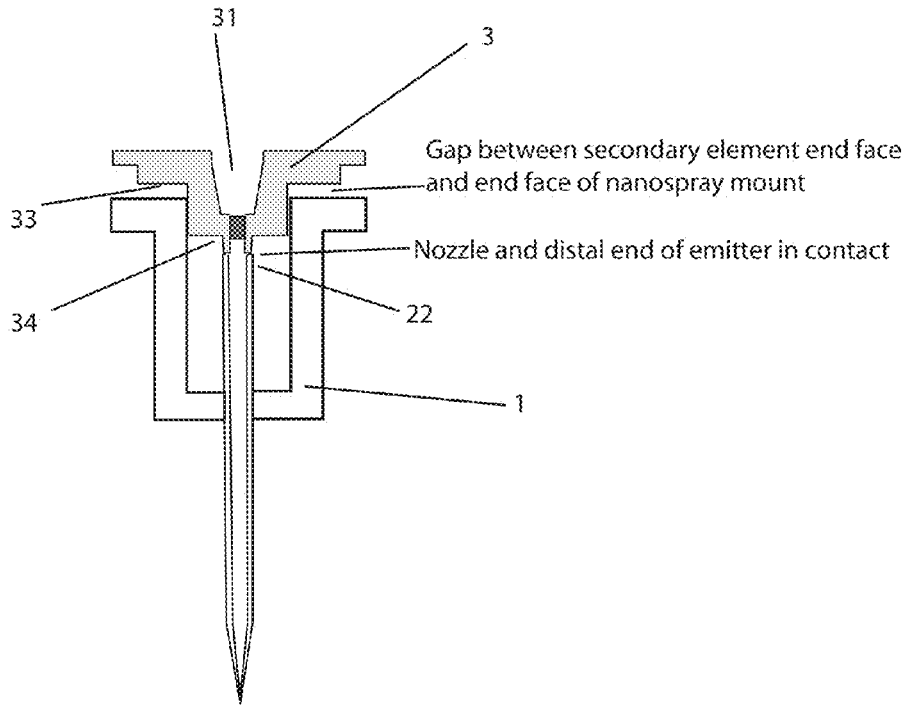
Figure 4. Mating Detail.
When the nozzle and distal end of the nanospray emitter are in contact there is a gap between the end faces between the nanospray emitter mount and the secondary fluidic element.

SAMPLE PREPARATION AND NANOELECTROSPRAY IONIZATION MASS SPECTROMETRY

This is a 371 of PCT/US2013/037138 filed 18 Apr. 2013 (international filing date).

This invention relates to a system for sample preparation, sample storage, and subsequent ionization and analysis by nanoelectrospray ionization mass spectrometry. The principle utility of the invention is in the area of chemical analysis by electrospray ionization mass spectrometry (ESI-MS). It is suitable for the biochemical analysis of biological samples. It is particularly well suited, but not limited to, the identification and quantification of proteins and peptides present in biological tissues and/or fluids.

BACKGROUND OF THE INVENTION

Miniaturization of chemical analysis is a highly active area of intense scientific research. Much of the research is driven by the health and life sciences, where miniaturization has the capacity to revolutionize the diagnosis and treatment of disease [Yager et. Al Nature 2006, 442, 412-418; Chin, Linder, Sia Lab Chip, 2007, 7, 41-57]. Central to this theme is the miniaturization of processes and procedures that occur in conventional chemical and biological laboratories. These activities include sampling, storage, sample treatment, separation, detection, and analysis. Miniaturization uses less sample, offers superior detection sensitivity, and has the potential to greatly reduce the costs of laboratory environment, labor, and materials. Efforts at miniaturization have focused primarily on the implementation of so-called microfluidic "lab-on-chip" devices [Chin, Linder, Sia, Lab Chip, 2007, 7, 41-57], although more conventional methods, such as lateral flow chromatography, have also been reduced in scale [Yager et. Al Nature 2006, 442, 412-418].

A particularly promising analytical technology for medical diagnostics from biological tissues and fluids is liquid chromatography coupled to mass spectrometry (LC-MS) [Hoofnagle, Clin. Chem. 2010, 56, 161-164; Anderson Clin. Chem. 2010, 56, 177-185]. LC-MS is a powerful method, but requires a highly complex analytical system. Current state-of-the-art practice requires expert level training of staff, together with a significant investment in laboratory infrastructure. Centralized laboratory resources coupled together with remote sampling of patient populations is a common solution to meet these multiple requirements for clinical analysis.

Electrospray ionization is a well-established method to ionize liquid samples for chemical analysis by mass spectrometry. Nanoelectrospray ionization, also referred to as nanospray, is a miniaturized low-flow and low-volume variant of electrospray ionization. Nanospray has been shown to offer superior sensitivity and selectivity compared to conventional electrospray ionization. Nanospray is the path to chemical miniaturization for mass spectrometry.

Various methods have been developed for using nanospray for either off-line analysis of individual discrete liquid samples, or on-line analysis of flowing liquid streams, e.g. the effluent from liquid chromatography. Off-line nanospray, which is the subject of this invention, is also referred to in the prior art as static nanospray.

Diagnostic testing places strict demands on the mass spectrometric analytical system. It is highly desirable for a diagnostic analysis to have no interference from one sample analysis to the next (also known as zero "carry over"). In a miniaturized analytical system, where the surface-area-to-volume ratio is high, a non-redundant fluid path is preferred. Thus a nanospray system having a non-redundant fluid path is preferable for application in a clinical setting.

A commonly employed apparatus for off-line nanospray utilizes a nanospray emitter fabricated from a tube, typically 1-2 mm inside diameter (ID), having a finely tapered end in which the ID tapers to a 1-5 μm ID orifice. The tapered end is referred to as the proximal end. A liquid aerosol emits from the proximal end during the electrospray process. Such emitters are generally fabricated from borosilicate glass, fused-silica, or fused quartz, although other materials including polymers and metals have been employed. The non-tapered end is referred to as the distal end, and is the end of the emitter to which sample is typically loaded. The nanospray emitter is commonly coated with an electrically conductive metal or polymer film. The coating covers the entire outer surface of the emitter and makes contact with the liquid sample, typically at the proximal end, although contact at the distal end is also feasible. The purpose of the electrically conductive coating is to establish a potential difference (typically 1000-5000 V) between the liquid inside the emitter and the inlet of the mass spectrometer.

A significant challenge for successful off-line nanospray is three-fold: (A) Samples must be fairly clean and concentrated prior to use. (B) Sample volumes should be low, preferably less than 10 uL, and more preferably less than 5 uL. (C) Sample transfer of microliter sample volumes into the emitter is time consuming, risky and difficult. Low volume samples for analysis are loaded into the emitter in one of four ways: Injection from a syringe using a fine needle, injection from a hand pipette using a finely tapered plastic tip, transfer from another (glass) capillary tube into the nanospray emitter by means of a centrifuge, or capillary action from a sample reservoir.

These methods are typically time consuming, expensive, and/or require a great deal of hand manipulation and fine motor skills. The glass nanospray emitters are fairly delicate and fragile. The small ID's for the emitters (<2 mm) require the use of small diameter liquid injection tools. Expert level training is usually required for successful application of the technique. With perhaps the exception of method (3), these methods are poorly suited to low-cost, automated or high-throughput laboratory procedures.

Thus there is a significant need for a miniaturized system having a non-redundant fluid path for the isolation, storage, purification, and analysis of samples by nanospray ionization mass spectrometry. It is particularly desirable that the system be easy-to-use, low cost, and offer high throughput. It should enable discrete sampling and storage of samples in the liquid or dry state, remote from the analytical laboratory. It's use should require a minimum of specialized laboratory equipment, preferably limited to the apparatus commonly found in a clinical or hospital environment.

The present invention address these issues by applying desirable aspects of the centrifuge transfer method to the integration of nanospray with efficient sample preparation methods. In a preferred embodiment, the invention combines and couples nanospray to trap-and-elute sample preparation by solid phase extraction (SPE).

SPE is a generic term for a wide variety of well-established and well-known methods for the isolation and purification of target chemical compounds present in simple or complex mixtures from fluid (liquid or gaseous) samples. For example, U.S. Pat. Nos. 3,953,172; 4,142,858; 4,270,921; 4341635; 4650784; 4774058; 4820276; 5266193; 5279742; 5368729; 5391298; 5595653; 5415779; 5538634 describe methods and devices for carrying out solid-phase extraction from liquid or gaseous samples.

SPE is based on the extraction and concentration of target compounds present in the liquid (or gas) sample onto the surface of a high-surface area solid substrate, referred to as the solid phase. It is dependant on the affinity of a target compound for the specific surface chemistry of the solid phase. The solid phase is typically wetted by the sample, but is not soluble in the sample. High surface area solid phases are available in a wide variety of surface chemistry including hydrophilic, hydrophobic, and cationic (positively charged) and anionic (negatively charged).

The solid phase is typically porous in nature so that liquid samples may pass though the solid phase when a pressure difference is applied across the substrate. The pressure differential can be provided by: liquid pumps, pressurized syringes, the application of gas pressure or vacuum, or by centrifugation of liquid through the solid phase. When the liquid passes through the solid phase target compounds having a high affinity for the surface will be trapped and retained on the substrate surface. The volume of liquid that can be passed through the solid phase is generally unrestricted, and is typically many times (>10×) the volume of the substrate. This ratio provides the capability of concentrating the target compound from a large volume of liquid onto a small volume of substrate. A small volume solid phase also ensures that a smaller volume of liquid may be used for extraction.

The target compound is typically subsequenty removed from the solid phase by the process of elution. A volume of a liquid, referred to as the eluent, is chosen so that the target compound is highly soluble in the eluent. When the solid substrate is brought into contact with the eluent, the target compound is extracted from the solid phase surface, and dissolved in the eluent. By using a volume of eluent that is smaller than the original sample, the target compound will then be present in the eluent at a higher concentration than that of the original sample liquid. The volume of eluent is preferably much less (<one-tenth) than the volume of the original sample.

Assuming that 100% of the target compound in the original liquid sample is trapped by the solid phase, and that 100% of the trapped compound is extracted by the eluent; the practical concentration of target compound provided by SPE is dependant on the volume ratio of sample-to-eluent. In practice the degree of trapping and elution is less than 100%. The volumetric ratio of sample-to-eluent represents a practical upper limit for compound concentration with conventional SPE methodology.

SUMMARY OF THE INVENTION

The invention provides a novel format for performing chemical analysis by nanospray mass spectrometry. The combined features of the inventive system enables the loading, purification, transfer, and analysis of individual samples by the mass spectrometer without any direct handing of fragile nanospray emitters. Sample processing requires only common, unspecialized laboratory tools such as pitpettors and centrifuge. The novel system enables rapid analysis with a non-redundant fluid path and discards used consumables to waste to minimize exposure of the operator. The present invention provides an unexpected and surprising increase in target compound concentration as assessed by nanospray mass spectrometry. The increase in signal for target compounds is shown to exceed that of the simple volumetric ratio by more than three times. A rational hypothesis for the increase in signal sensitivity is that the effective elution volume provided by, and analyzed by, the invention is much less than the actual (applied) elution volume.

DETAILED DESCRIPTION

The system employs a method common to the prior art: A conventional glass nanospray emitter is fixed in a holder that enables it's use within a common laboratory (micro)-centrifuge tube. Mounting the emitter inside a micro-centrifuge tube allows for sample transfer from one fluid holding element to a second fluid holding element using the forces generated by a spinning centrifuge. The invention (FIG. 1) differs significantly from the prior art [Wilm, Mann Anal. Chem. 1996, 68, 1-8; U.S. Pat. Nos. 5,504,329, 5,608,217, 6,670,607] in that the design of the emitter holder is shaped in a specific way (FIG. 3) that it (A) accepts a removable, self-aligning, secondary fluidic element or cartridge, (B) permits efficient and laminar (non-turbulent) liquid transfer of sample from the secondary cartridge into the nanospray emitter, and (C) mates directly with a receiving device and system mounted on the mass spectrometer. Requirement (B), non-turbulent or laminar flow as liquid transfer from the secondary fluidic element into the nanospray emitter, can be promoted or ensured by the geometry of the surface contact between the outlet of the secondary fluidic element and the distal end of the nanospray emitter. It has been found to be particularly preferable for the outlet of the secondary fluidic element to mate directly with, and have surface contact with, the interior surface of the nanospray emitter and cause the liquid to take a transfer path that makes immediate contact with the inside surface of the nanospray emitter. The properties of (C) ensure that fragile emitters are not handled directly by the end user at any time. The emitters may be left in the micro-centrifuge tube until they are loaded for analysis on the mass spectrometer.

This secondary fluidic element (FIG. 2) is shaped so that it can hold a relatively large sample volume (10-100 uL) on the inlet side, hold a small volume (0.02-1 uL) of porous sorbent media in the center portion, and on the outlet side mates directly with the distal end of the nanospray emitter via the surfaces provided by the emitter holder. The mating features comprise a tapered nozzle shape having a conical or nipple like geometry. The ID of the secondary orifice is equal to or slightly less than (no less than 50%) the ID of the nanospray tube. The secondary element is designed so that it is also readily held in place at the rim a common micro-centrifuge tube. Thus a centrifuge may be used to load samples into the cartridge, and subsequently add one or more wash and elution solvents. When the cartridge is spun in the centrifuge liquid transfers through the porous sorbent media. The secondary cartridge is used much like commonly available spin columns, although it differs significantly from the prior art in that it has the described features that enable effective liquid transfer into a nanospray emitter. (FIG. 4)

When final sample elution and transfer into the nanospray emitter is desired, the secondary cartridge is transferred to the distal end of the emitter holder. A small volume of elution solvent is added to the cartridge (0.1-10 uL) and the assembly is spun in the centrifuge to effect transfer.

Once the sample is transferred into the nanospray emitter. The Micro-centrifuge tube containing the nanospray emitter assembly is transferred to the source of the mass spectrometer.

The source is designed to accept the assembly. First the source mechanism separates the micro-centrifuge tube from the nanospray emitter mount, and subsequently ejects the micro-centrifuge tube to waste. The mechanism then moves the nanospray emitter mount into a position suitable for the ionization of the sample contained within. At this point the source mechanism also makes high voltage contact with the emitter.

In the manual embodiment of the source, the assembly consisting of the micro-centrifuge tube, nanospray emitter mount, and secondary fluidic element is dropped into a recessed slot contained within the top of the source housing. The assembly is held together in the slot within the body of the source. The slot is shaped to accept the assembly and also to permit movement of the assembly in one or more directions within the body of the source. The slot is also shaped to permit separation of individual elements of the assembly by further mechanical action. It is preferable to effect this action through the use of one or more sliding or rotary actuators or levers. In this particular embodiment, a first lever is actuated. This lever is connected to an element that physically separates the micro-centrifuge tube from the rest of the assembly in the vertical direction. This separation eliminates the direct contact between the nanospray emitter mount and the micro-centrifuge tube. A second lever is then actuated. This second lever is integral to the slot, and has elements which engage and support the micro-centrifuge tube. When this second lever is moved, the micro-centrifuge tube is released and drops through the remaining body of the source due to gravity, and is collected in an appropriate waste container. After subsequent additional movements of the second and first levers, the remaining assembly, consisting of the nanospray emitter mount and secondary fluidic element is translated within a second slot contained within the source housing. This translation moves the assembly close to the inlet of the mass spectrometer. When the assembly is moved into it's desired operating position, the lever also has the effect of engaging and making electrical contact of the conductive coating on the nanospray emitter with the high voltage power supply necessary for the operation of electrospray ionization. Such electrical contact is preferably established through the use of conductive elements such as compliant metal springs or an electrically conductive elastomer contained within the body of the source. These elements are then in electrical contact with the high-voltage power supply. It is important that the physical electrical contact not destroy the conductive coating on the emitter, damage the glass substrate, or disturb the position of the emitter. The assembly is now in the correct position for the ionization of sample for chemical analysis.

When ionization is finished, the first lever is again engaged by the operator. It is manipulated so as to move the assembly away from the inlet of the mass spectrometer. This movement also breaks the electrical contact to the power supply. Further movement of the first lever translates the assembly through the slot within the housing to hole (71) that permits the assembly to drop by gravity from the source into a suitable waste collection container.

The following figures and examples demonstrate the use of the invention.

BRIEF DESCRIPTION OF THE DRAWINGS

FIG. 1 is an expanded view of the components of a nanospray sample preparation system (100) illustrating nanospray emitter (2) in nanospray emitter mount (1), secondary fluidic element (3) with porous solid phase extraction bed (4) inserted therein, micro-centrifuge tube (5) and liquid tight cap (6) for the assembly.

FIG. 2 is a detailed illustration of secondary fluidic element (3), showing sample reservoir (31), flange (32) for mating with the microcentrifuge tube, flange (33) for mating with the nanospray emitter mount, nozzle (34) for mating with the distil end of the emitter and porous solid phase extraction bed (4).

FIG. 3 is a detailed illustration of nanospray emitter mount (1) with emitter (2) mounted therein, showing the distal end (22) and proximal end (23) of the emitter, bore (11) for the secondary fluidic element and flange (12) for mating with the micro-centrifuge tube.

FIG. 4 is a detailed illustration of the nanospray emitter mount (1) with secondary fluidic element (3) mounted therein and nozzle (34) mating with distill end (22) of emitter (2).

EXAMPLES

Example 1

Figure 5:
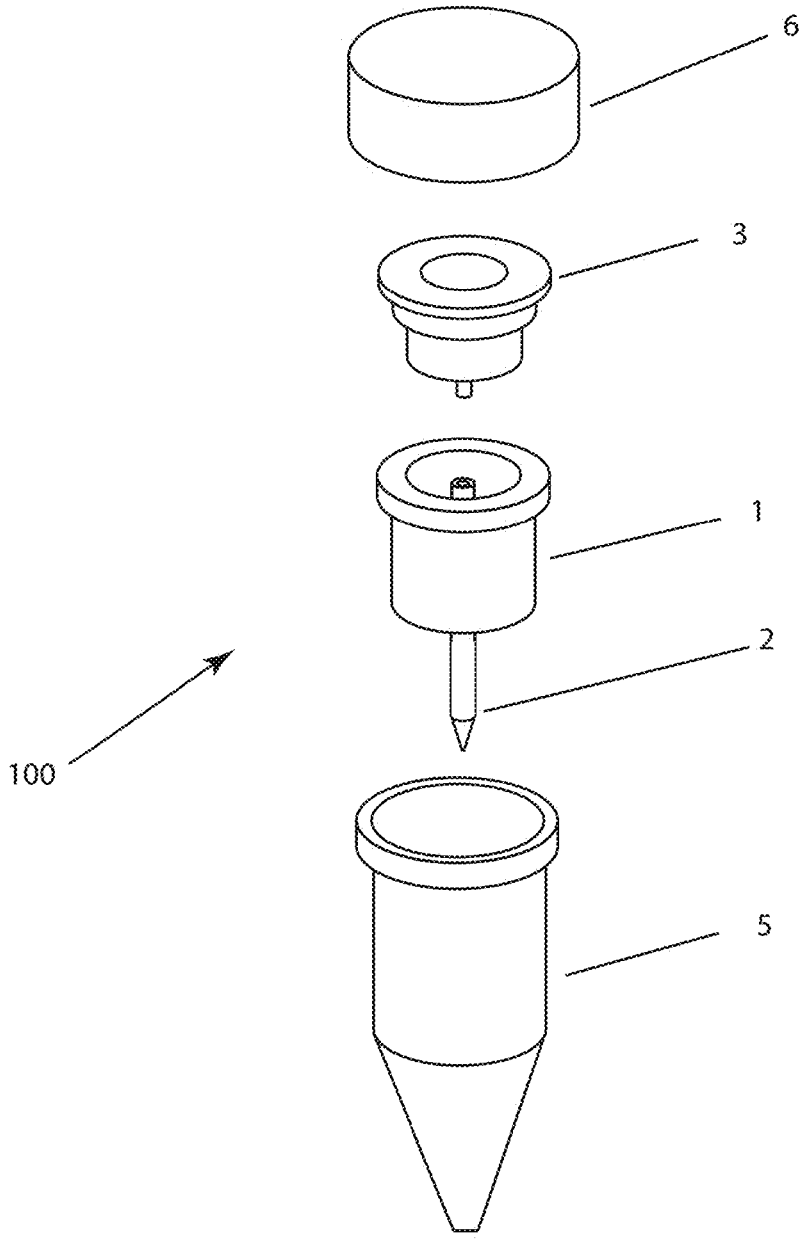
FIG. 5 is an isometric illustration of the elements of the nanospray sample preparation system shown in FIG. 1.

Efficient Loading of a Microliter Scale Sample

An emitter assembly consisting of a nanospray emitter, nanospray emitter mount and secondary fluidic element, as shown in FIG. 4 was prepared. A nanospray assembly consisting of the emitter assembly and microcentrifuge tube was then assembled, as shown in FIG. 1 but without the cap. The mounted glass nanospray emitter was fabricated from 1.2 mm outside diameter, 0.69 mm inside diameter borosilicate glass tubing. The emitter had a 2 μm inside diameter orifice at it's tapered proximal end, and was coated with an electrically conductive platinum metal film. The nanospray emitter protruded approx. 20 mm from the emitter mount. Total emitter length was approximately 25 mm. The diameter of the though hole connecting the secondary fluidic element with the distal end of the nanospray emitter was 0.2 mm. The diameter of the sample reservoir in the secondary fluidic element was 3.1 mm. The secondary fluidic element was initially empty, and did not have a porous solid phase extraction bed in place.

A sample of the chemical compound buspirone (CAS number 36505-84-7, formula weight=385.5 Da) was prepared at a concentration of 1 ug/mL in 50% acetonitrile, 0.1% formic acid. 5 uL of this sample was delivered into the sample reservoir of the secondary fluidic element using a conventional laboratory micro-pipettor (Eppendorf corp.). The nanospray assembly was capped and loaded into a fixed rotor centrifuge (Eppendorf model 5414C) and spun at a force of 326 g (2000 rpm) for approximately 30 sec.

During centrifugation, the sample passed through the secondary fluidic element into the nanospray emitter. Greater than 85% of the total volume was transferred into the nanospray emitter. The nanospray assembly was then removed from the centrifuge.

A nanospray source built to accept the nanospray assembly, and shown schematically in FIGS. 6 through 11, was mounted on a linear ion trap mass spectrometer (Thermo Fischer LTQ).

Figure 6:
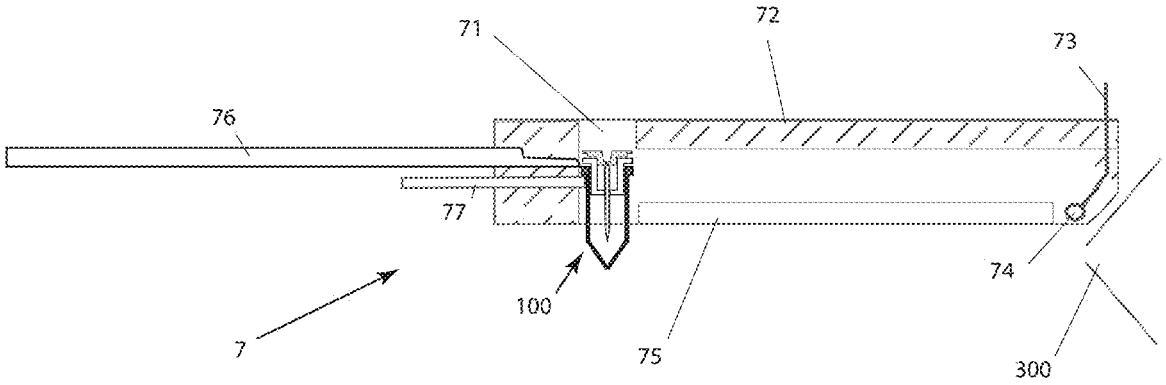
FIG. 6 is an illustration of a nanospray source (7) for use with the nanospray sample preparation system (100), having a hole (71) to accept the nanospray assembly, a source housing (72), a high voltage source (73) with high voltage contact (74), slot (75), transfer arm (76) and release arm (77), shown supporting the nanospray preparation system by the flange on the micro-centrifuge tube. The high voltage contact (74) is adjacent to a mass spectrometer inlet (300).
Figure 7:
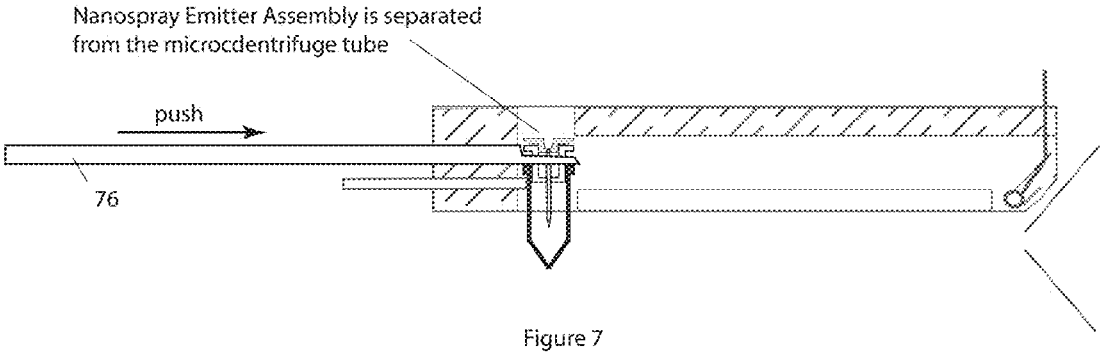
FIG. 7 illustrates transfer arm (76) being pushed to separate the nanospray emitter assembly of the nanospray emitter mount, the nanosopray emitter and the secondary fluidic element from the micro-centrifuge tube.
Figure 8:
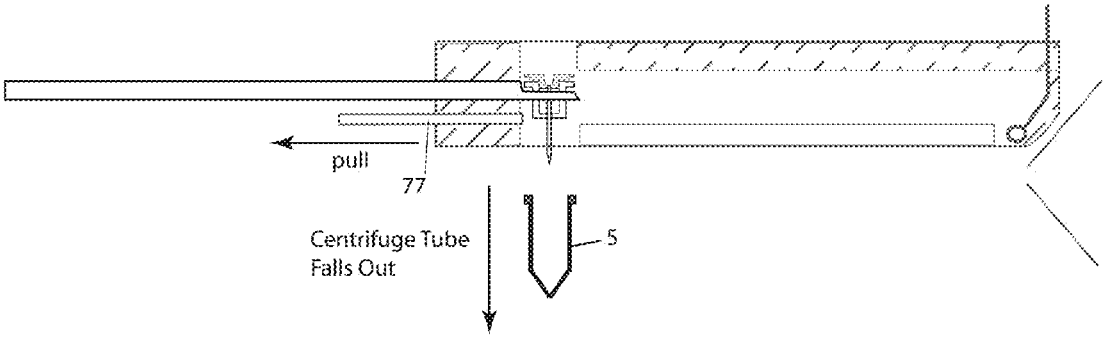
FIG. 8 illustrates release arm (77) being pulled away from the micro-centrifuge tube, whereby the microcentrifuge tube is no longer supported and falls away.

The nanospray assembly was dropped into the hole on the top side of the nanospray source (FIG. 6). The assembly is prevented from falling through the source by a release arm that permits only partial penetration of the assembly though the source by interfering with the rim of the microcentrifuge tube. A transfer arm is then pushed in place by sliding it towards the nanospray assembly (FIG. 7). A tapered U-shaped element on the front of the transfer arm (A) physically separates the emitter assembly from the microcentrifuge tube by raising it approx. 2 mm above the rim of the microcentrifuge tube, and (B) captures the emitter assembly for positioning. As shown in FIG. 8, the release arm is pulled back, and the microcentrifuge tube falls away from the nanospray source due to gravity.

Figure 9:
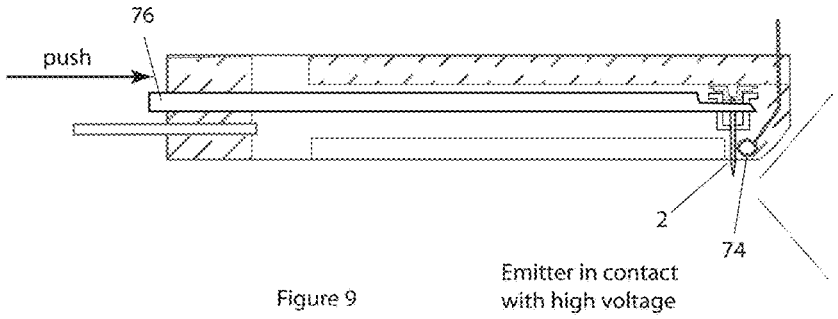
FIG. 9 illustrates transfer arm (76) being pushed to transport the nanospray emitter assembly through the slot to the end of the source (7) that is adjacent to the mass spectrometer inlet (300) and into contact with the high voltage contact (74).

The transfer arm is then pushed fully forward (FIG. 9). This carries the remaining elements of the nanospray assembly, i.e., the emitter assembly, through a slot in the bottom of the nanospray source housing to the forward position. In this position, the conductive coating on the nanospray emitter is in contact with a spring loaded electrical contact within the body of the nanospray source housing. This contact is in turn connected to a 1.5 kilovolt high voltage power supply coming from the mass spectrometer.

Figure 12:
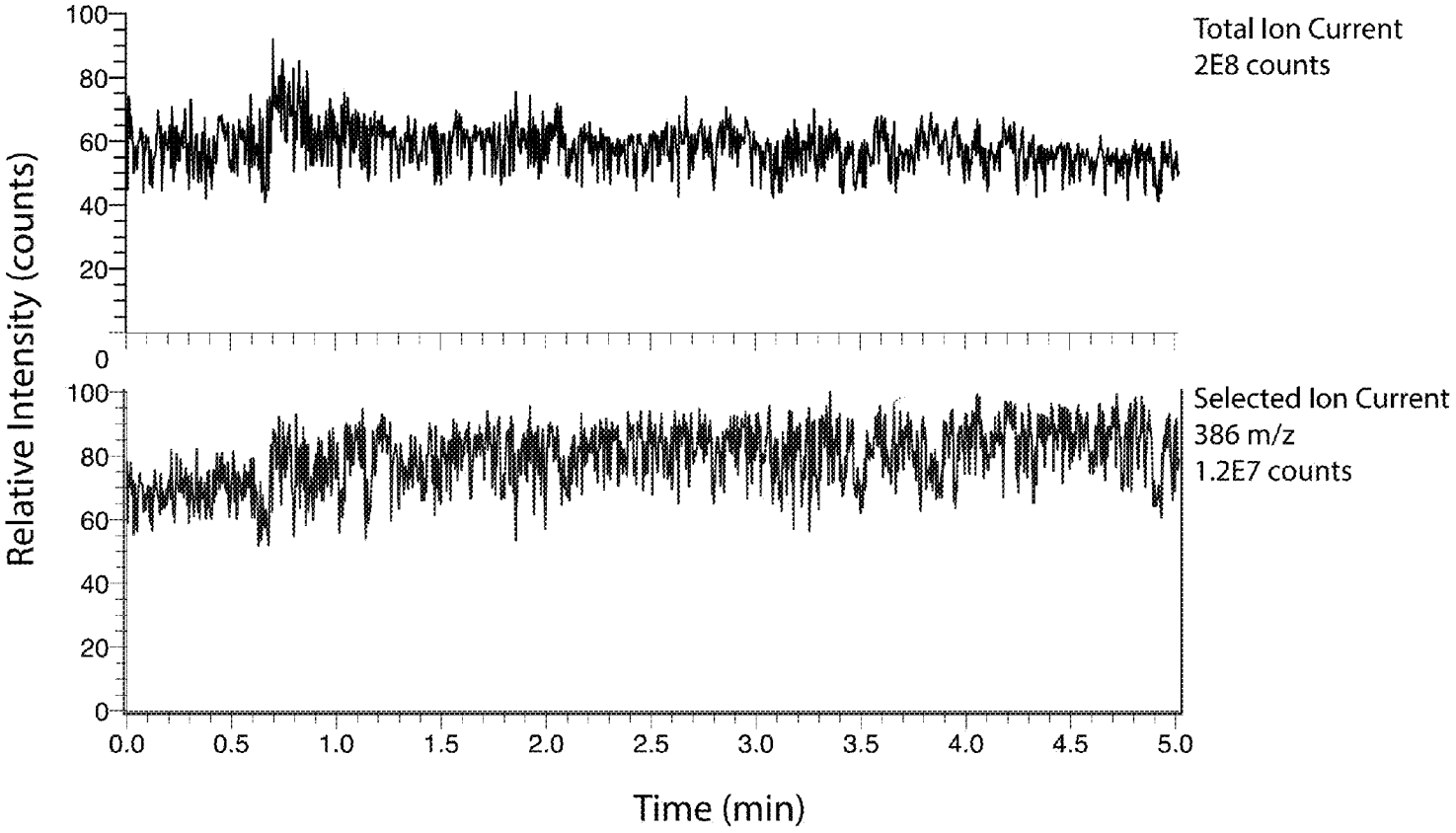
FIG. 12 illustrates five minutes of data collection of both total ion current (top) and the ion current of protonated buspirone molecular ion (bottom) in the procedure of Example 1.

This voltage is sufficient to cause electrospray ionization to occur. As the proximal end of the nanospray emitter is now in close proximity to the mass spectrometer inlet (within 3 mm), ionization signal is obtained. FIG. 12 shows five minutes of data collection of both total ion current (top) and the ion current of the protonated buspirone molecular ion (bottom) at a mass-to-charge ratio of 386 m/z from the mass spectrometer.

Figure 10:
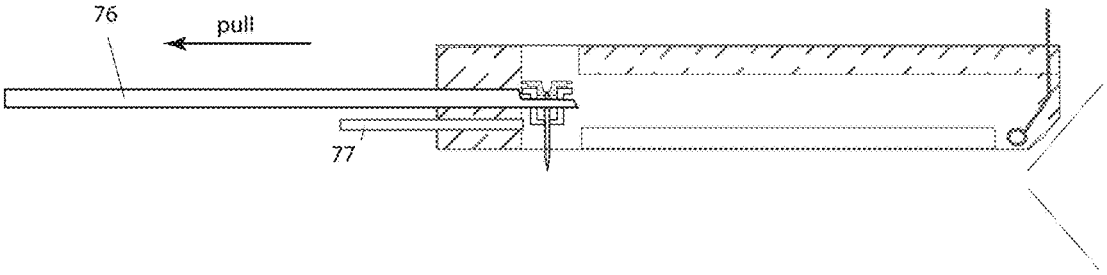
FIG. 10 illustrates the nanospray emitter assembly being withdrawn by the transfer arm to a position above the hole in the source body.
Figure 11:
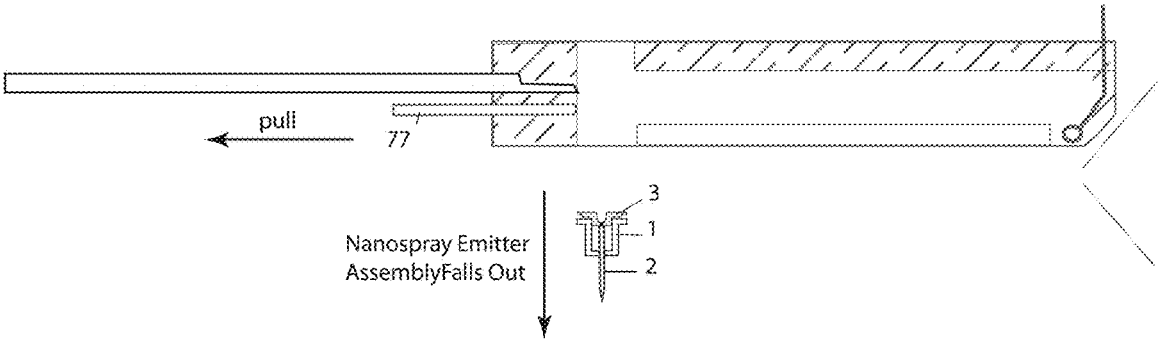
FIG. 11 illustrates the transfer arm being separated from the nanospray emitter assembly, whereby the nanospray emitter assembly is no longer supported and falls away.

After data collection, the transfer arm is pulled away until the nanospray emitter assembly is positioned over the hole (FIG. 10). Further pulling of the transfer arm causes the nanospray emitter assembly to make contact with the side of the housing wall. This releases (FIG. 11) the emitter assembly from the transfer arm and it falls away from the source housing due to gravity.

Example 2

Rapid Analysis of Multiple Samples

The system of example 1 was used to evaluate the performance for the analysis of multiple samples. Samples A, B, and C of commercially available peptides (Sigma-Aldrich Corporation) were prepared individually at a concentration of 1 ug/mL in 50% acetonitirle and 0.1% formic acid for a total volume of 100 uL each. Sample A was Angiotensin I (Sigma catalog number A9650-1 MG, formula weight=1296 Da). Sample B was valine substituted Angiotensin I (Sigma catalog number A9402-1 MG, formula weight=1282 Da). Sample C was Angiotensin II (Sigma catalog number A9525-1MG, formula weight=1045 Da). As in example 1, 5 uL of samples A, B, and C were individually loaded into the secondary fluidic element of three nanospray assemblies, respectively. The three assemblies' were placed in the rotor of the micro-centrifuge used in example 1 and simultaneously spun using the same conditions.

The mass spectrometer was placed into data collection mode and a data file was acquired during the entire nanospray source loading process. After removal of the three micro-centrifuge tubes from the centrifuge, the first sample, sample A, was placed in the nanospray source and the transfer and release arms were manipulated as in example 1 (FIG. 9), positioning sample A in the signal collection position. Signal was collected for approximately 20 seconds. The transfer arm was pulled back to eject sample A from the source. The release arm was then pushed forward and sample B was loaded into the source. The release arm and transfer arm were again manipulated as in example 1 (FIG. 9) to position sample B for signal collection. Signal was collected for approximately 20 seconds. The transfer arm was pulled back to eject sample B from the source. The release arm was then pushed forward and sample C was loaded into the source. The release arm and transfer arm were again manipulated as in example 1 (FIG. 9) to position sample C for signal collection. Signal was collected for approximately 20 seconds. The transfer arm was pulled back to eject sample C from the source. The data collection of the mass spectrometer was then stopped.

Figure 13:
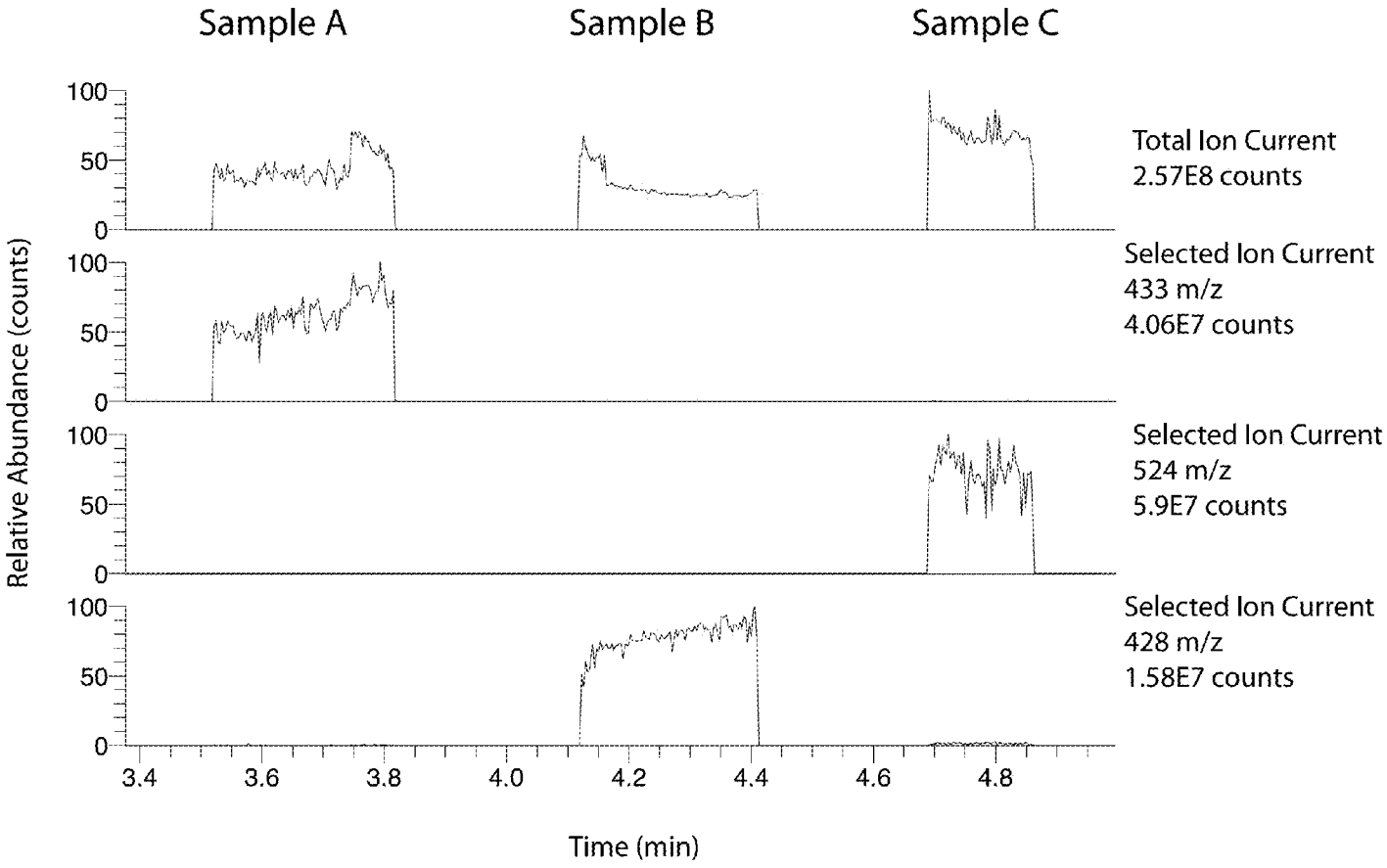
FIG. 13 illustrates the results of an analysis of three samples using the system of Example 1.

FIG. 13 shows the output of the resulting data collection file. The total ion current, and molecular ion current for samples A, B, and C are shown. Sample A shows the triply protonated molecular ion at a 433 mass-to-charge ratio. Sample B shows the triply protonated molecular ion at a 428 mass-to-charge ratio. Sample C shows the doubly protonated molecular ion at a 524.5 mass-to-charge ratio. This device demonstrates fast sample throughput with zero experimental carry-over from one sample to the next due to the non-redundant fluid path in which a single assembly (100) is used only once for the processing and analysis of an individual sample. Even with manual loading, the analysis of three samples occurred within a 1.5 minute time frame.

Example 3

Analysis Combined with Solid Phase Extraction for Sample Preparation

The system of example 1 was modified so that the secondary fluidic element contained a porous sorbent media, suitable for sample preparation and concentration by solid phase extraction. The porous sorbent media was contained within the narrow portion of the fluidic element's inner through bore, just prior to the proximal end of the fluidic element that mates with the distal end of the nanospray emitter.

In this specific example, the porous sorbent media consisted of a plug of Empore™ C18 extraction disk media (3M corporation, part number 2315). The plug of Empore was approx. 0.43 mm in diameter by 0.5 mm thick, representing a total volume of approx. 0.073 μL. The Empore disk is a fibrous network of PTFE (Teflon®) with adsorbent particles (90% by weight) embedded and bonded to the PTFE (10% of the disk by weight). This porous disk allows the passage of liquid through the disk pass but traps semi- or non-volatile organic compounds that are adsorbed by the embedded sorbent particles. Other types and chemical formulations of sorbent media would also prove suitable, such as conventional packed particle beds or polymerized monolithic structures.

A sample containing a mixture of known peptide standards was prepared in 0.1% formic acid at a concentration of 1 ug of protein, per millileter for each peptide. Peptides in the mixture included those used in example 2. The mixture contained: Angiotensin I (Sigma catalog number A9650-1MG, formula weight=1296 Da), valine substituted Angiotensin I (Sigma catalog number A9402-1 MG, formula weight=1282 Da), and Angiotensin II (Sigma catalog number A9525-1MG, formula weight=1045 Da).

A secondary fluidic element containing the Empore extraction media was placed on top of an empty micro-centrifuge tube. The Empore extraction media was then chemically conditioned prior to use, according to the manufacturer's recommendations. A 40 uL aliquot of methanol was transferred by pipette into the secondary fluidic element reservoir. This assembly was placed in a micro-centrifuge and briefly spun at a force of 326×g (2000 rpm for less than 1 minute) forcing the methanol through the media. 40 uL of 0.1% formic acid was then added to the reservoir of the secondary fluidic element and again spun in the centrifuge to condition the sorbent just prior to sample loading.

A 40 μL aliquot of the sample mixture was then loaded into the secondary fluidic element reservoir by pipette and it was again spun in the centrifuge under identical conditions. At this point, any chemical compounds present in the mixture, having sufficient hydrophobic character, will be chemically adsorbed to the surface of the sorbent media particles.

The loaded secondary fluidic element is then transferred to an assembly consisting of a second micro-centrifuge tube and a nanospray emitter assembly as previously described in example 1.

A 5 μL aliquot of extraction solvent consisting of 0.1% formic acid and 80% acetonitrile (by volume) was added to the secondary fluidic element reservoir.

The assembly was then transferred to the centrifuge and again spun at a force of 326×g (2,000 rpm) for less than one minute.

The assembly was then placed into the nanospray source apparatus operated and identically as described in example 1.

Example 4

The same sample peptide mixture of example 3 was then analyzed in a manner identical to that of example 1, to generate baseline data for a non-SPE prepped sample. This comparison allows one to characterize the efficiency and benefit of the SPE sample preparation step of example 3.

Figure 14:
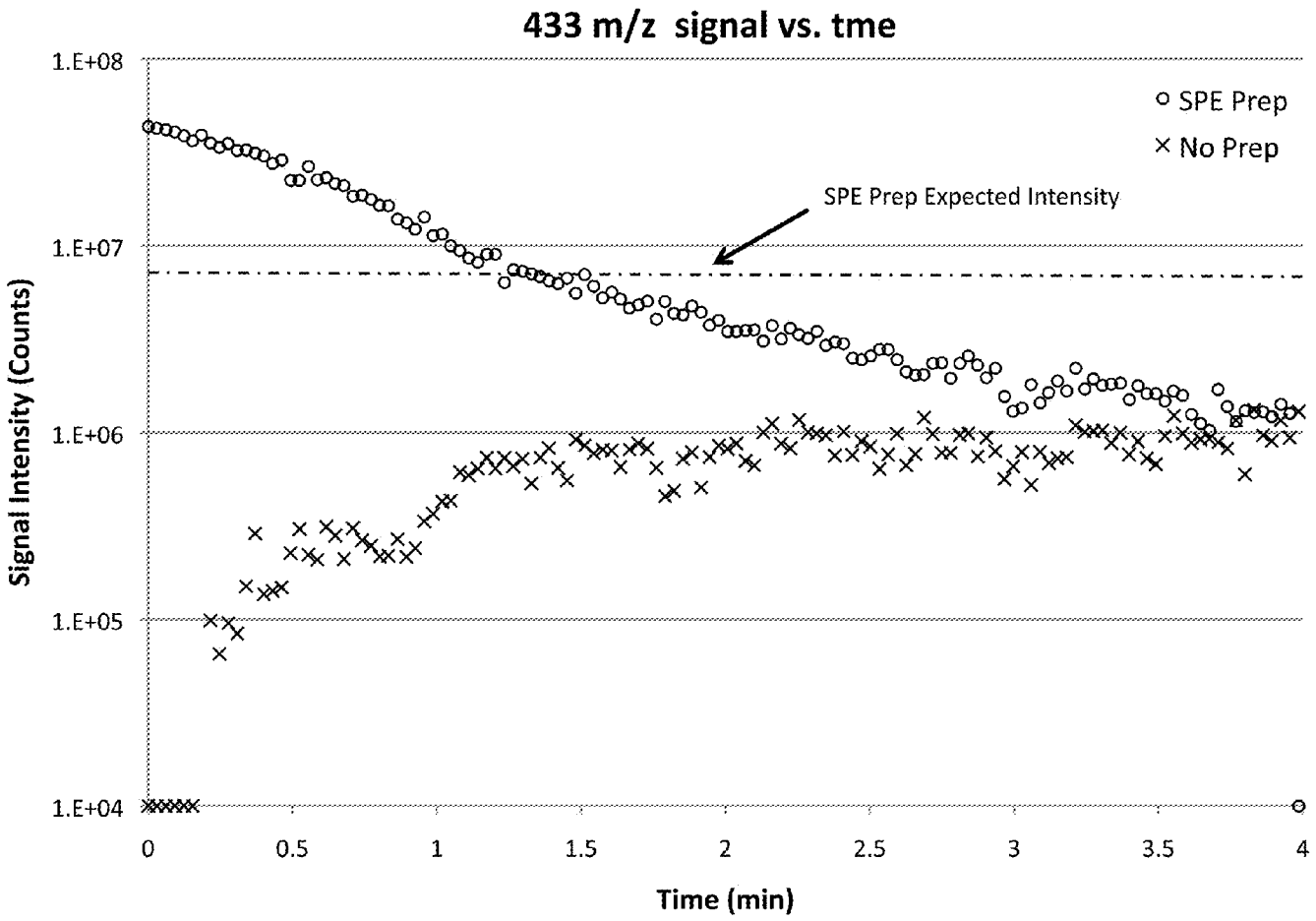
FIG. 14 illustrates the enhanced effect of mass spectrometer analysis with solid phase extraction (SPE) as compared to conventional (non SPE) analysis of triply charged Angiotensin I molecular ion at 433 m/z.
Figure 15:
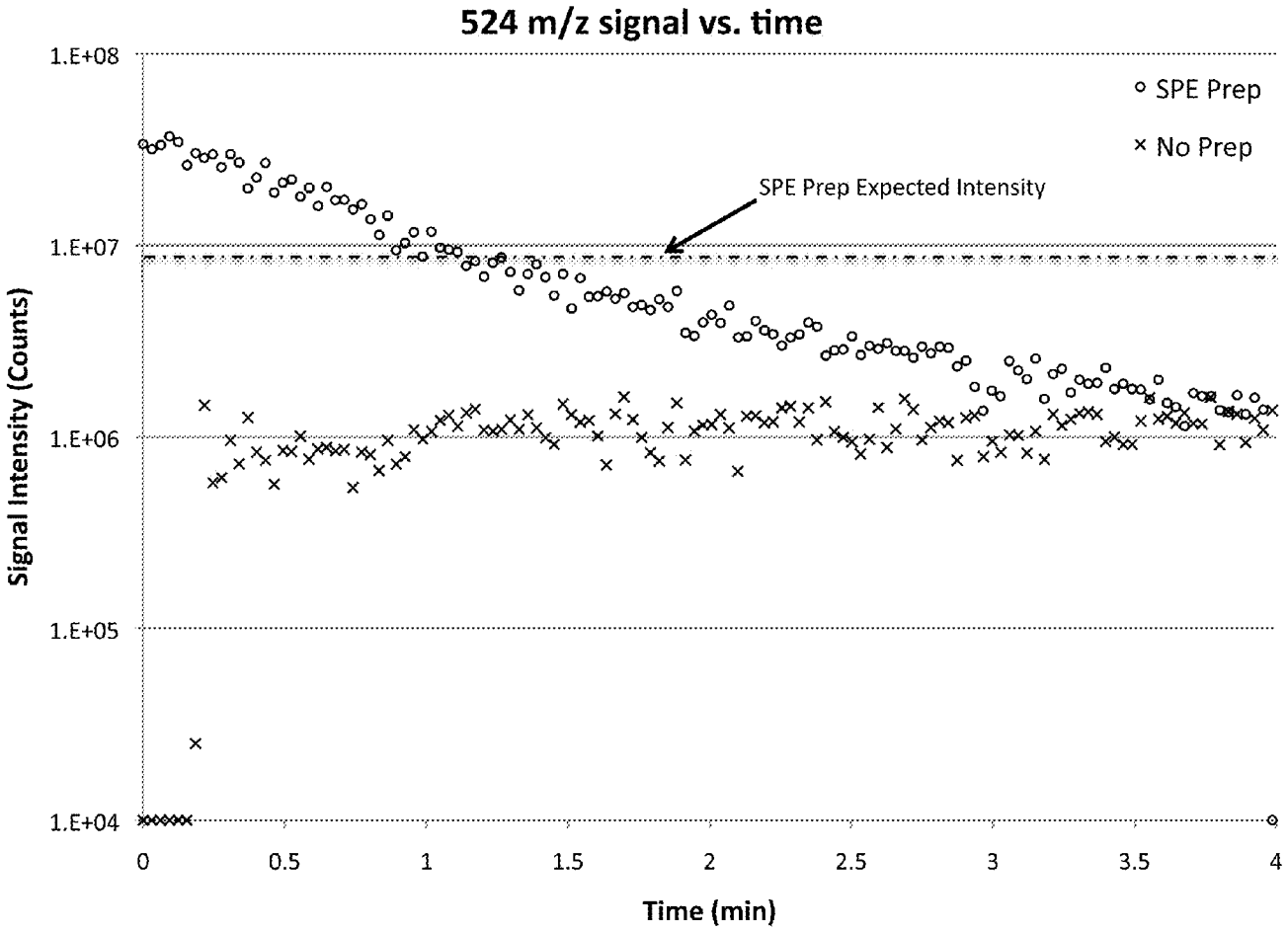
FIG. 15 illustrates the enhanced effect of mass spectrometer analysis with solid phase extraction (SPE) as compared to conventional (non SPE) analysis of doubly charged Angiotensin II molecular ion at 524 m/z.
Figure 16:
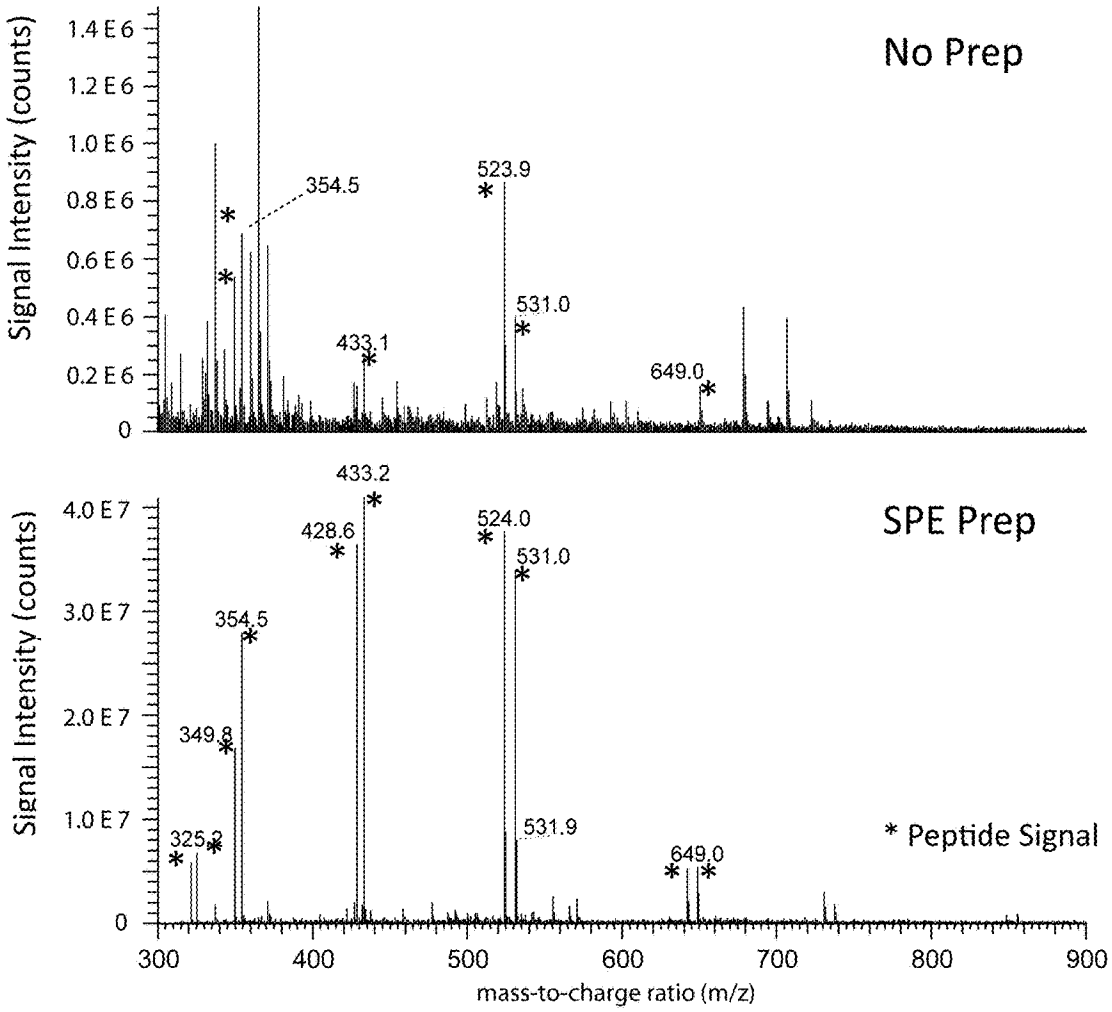
FIG. 16 compares averaged full scan mass spectra for non SPE prepared samples (top) and SPE prepared samples (bottom).
Figure 17:
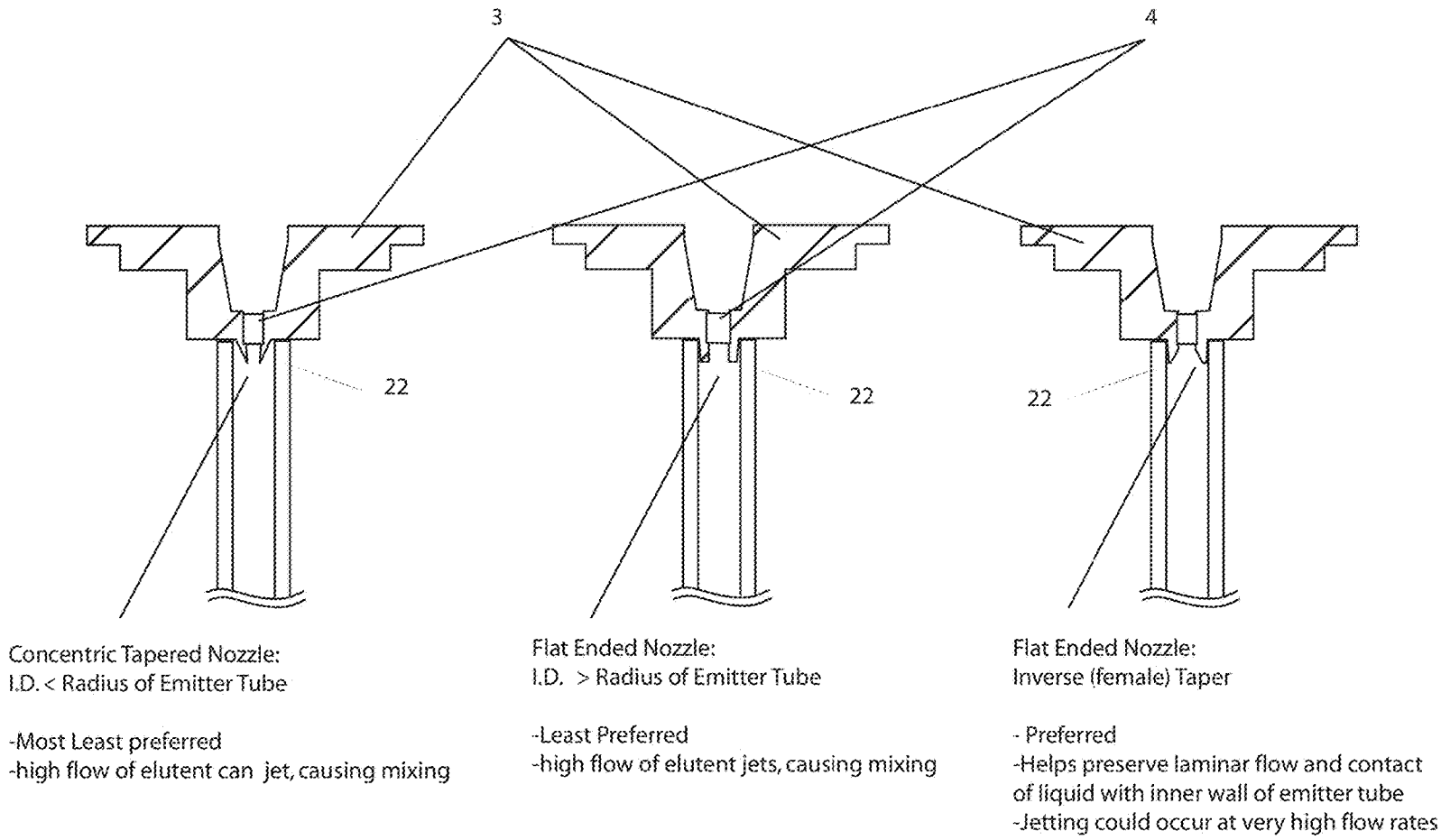
FIG. 17 shows three different embodiments (most least preferred, least preferred, and preferred) for the mating action between the nozzle of the secondary fluidic element (3) and the distal end of the nanospray emitter (22).
Figure 18:
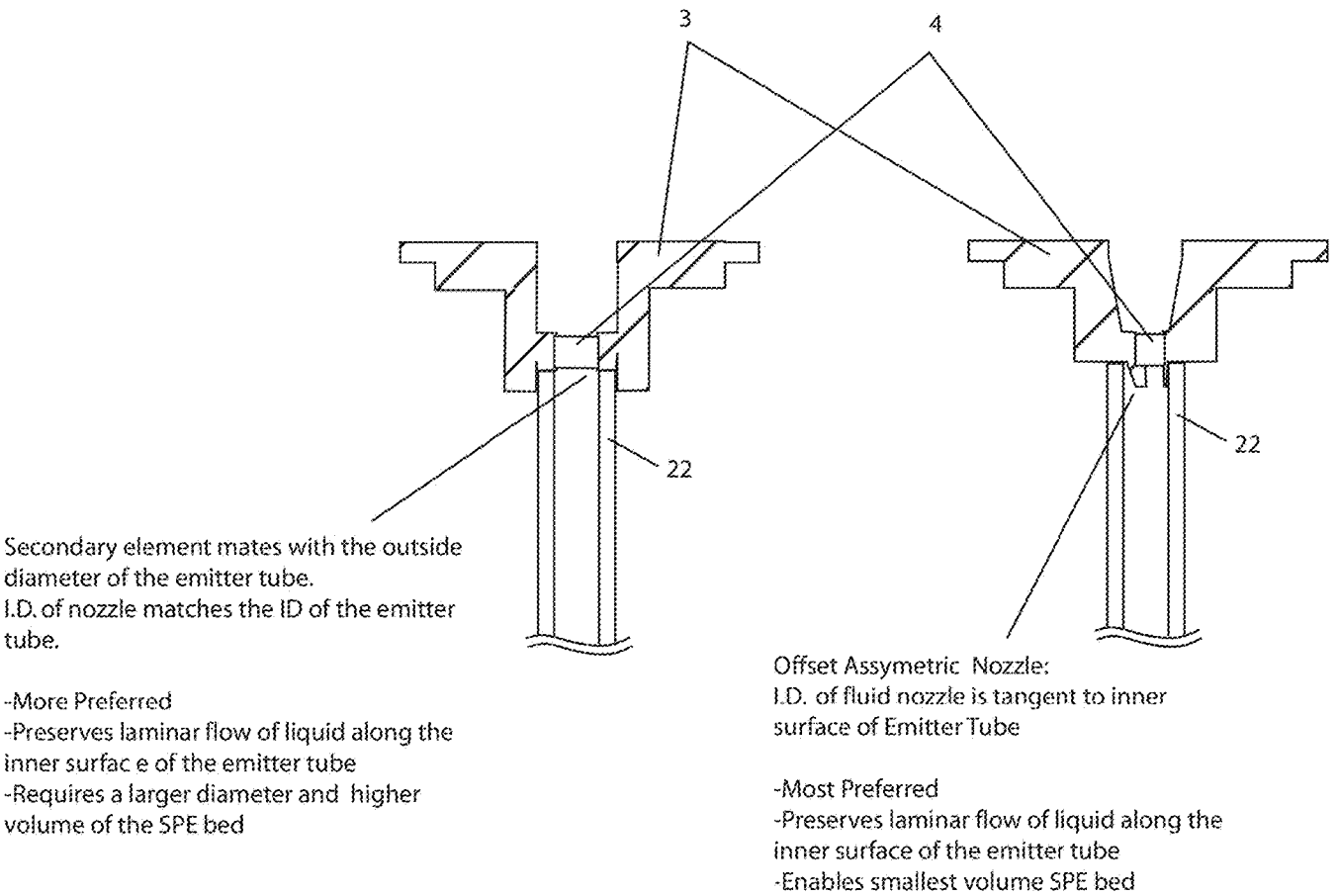
FIG. 18 shows two additional embodiments (more preferred, most preferred) for the mating action between the nozzle of the secondary fluidic element (3) and the distal end of the nanospray emitter (22).
Figure 19:
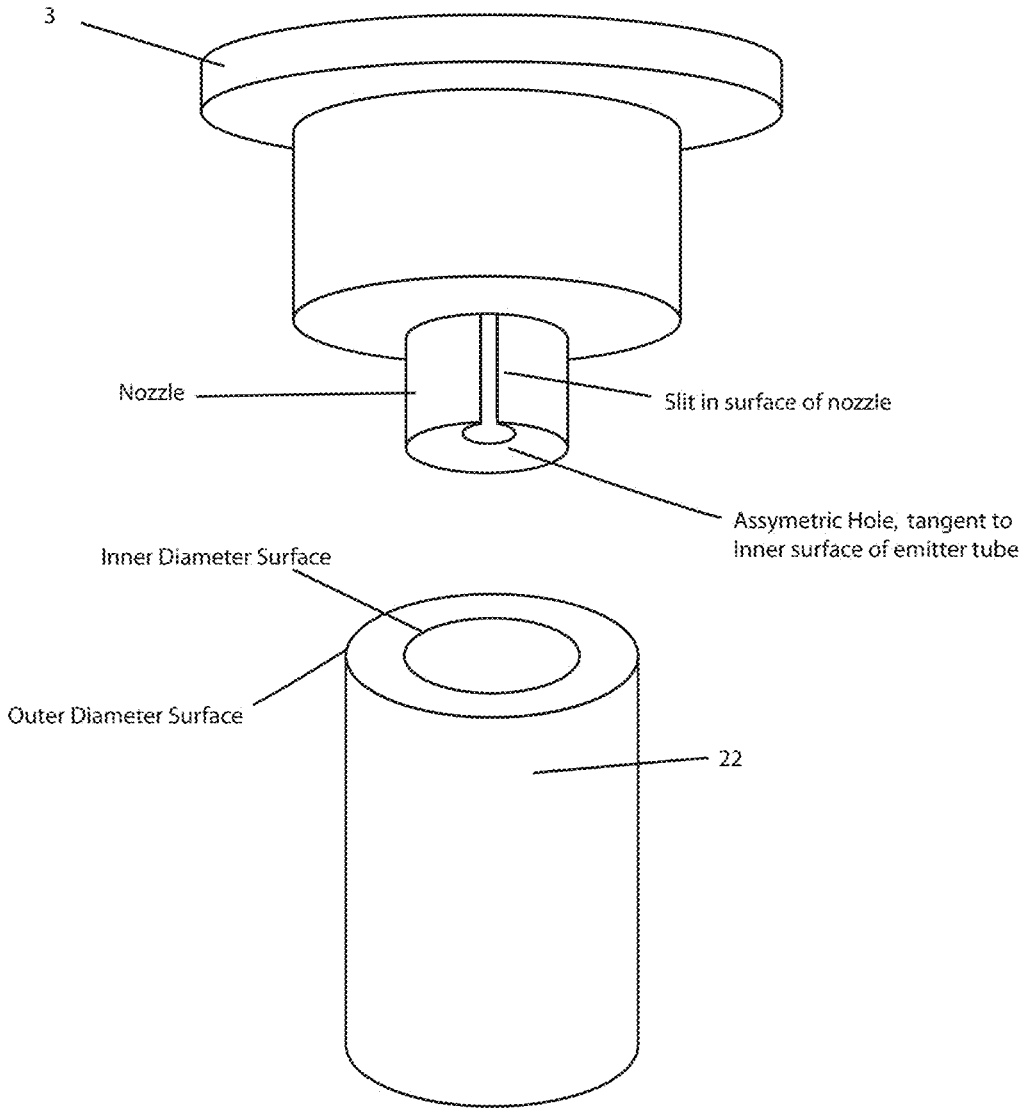
FIG. 19 shows a detailed view of the most preferred embodiment for the nozzle of the secondary fluidic element (3) in relation to the distal end of the nanospray emitter (22).

Data from each acquisition (non-SPE and SPE preparation) of this sample is shown in FIGS. 14, 15, and 16.

FIGS. 14 and 15 show the surprisingly enhanced effect of this implementation of solid phase extraction compared with analysis of the conventional (non SPE) ion intensities, shown as black crosses. The obtained intensity with SPE sample preparation is shown as open circles for the triply charged Angiotensin I molecular ion at 433 m/z (FIG. 14) and the doubly charged Angiotensin II at 524 m/z (FIG. 15). The expected signal intensity assuming 100% trapping and extraction efficiency is shown by the dashed line in each figure.

In each case, the obtained peak ion intensity is nearly an order of magnitude higher in intensity that that predicted by the volumetric ratio of the sample volume to extraction solvent volume (8:1). This means that the effective extraction volume (the volume that the analyte is contained in) must be much smaller than the actual applied extraction volume, thus providing a surprising and advantageous analytical outcome. A non-homogenous distribution of analyte within the nanospray emitter tube explains this favorable outcome. The inventive device and method enables the results one would obtain with the use of the smallest volume necessary for the extraction of analyte from the sorbent bed. Because the invention is able to use a larger volume than necessary to complete the extraction process while preserving the results of the smallest necessary volume, there is no additional requirement for exceptional expertise, apparatus, or equipment for effective use of smaller volumes and little analytical penalty for the use of higher-than-necessary extraction volumes.

FIG. 16 compares averaged full scan mass spectra (17 scans taken from the 0.5 minute after the start of acquisition) for no-prep (top) and SPE prep sample (bottom). Note the far superior signal-to-noise ratio for the SPE prepped sample. Again the volumetric ratio of the SPE process would predict ion intensity approx. 8× that of that obtained of the unprocessed sample. Actual ion intensities for the prepped sample are significantly higher. For example the 524 m/z ion shows an intensity between $6\times10^5$ to $1\times10^6$ counts in the no-prep sample. Assuming a 100% sample trap and elute efficiency for SPE, the volumetric benefit of SPE should yield a signal intensity of approx. 8× this level, or $8\times10^6$ counts. In actuality, the signal obtained for the SPE prep was approx. $3.6\times10^7$, a realized gain of 35×. This is a signal intensity that is 437% greater than the maximum expected for a fully efficient trap and extraction procedure. A similar result, based on the use of smaller extraction volumes with traditional methods, would require a reduction of the actual eluent volume from 5 μL to 1/35 that value (0.14 μL).

Example 5

Use of an Alternate Sorbent Media

The apparatus used in examples 3 and 4 were modified to demonstrate the use of the invention with an alternate solid phase sorbent media, substituting for Empore media, inside the secondary fluidic element.

The Empore extraction membrane was replaced with a layered-sorbent bed that consisted of a glass fiber filter disk frit (Whatman Corporation Filter paper type GF/A) and a packed bed of 5 μm spherical and porous (30 nm pore) octa-decylsilyl (C18) bonded silica particles (W.R. GRACE corporation). The overall dimensions of the glass filter and packed particle bed inside the secondary fluidic element were roughly the same as the Empore membrane disk, having a diameter of 0.43 mm and a thickness of between 0.5 to 0.6 mm. This type of layered construction for an SPE device and method is well known and described in the prior art.

An identically prepared sample to that used in example 3 was processed to establish the relative performance for SPE enrichment of the packed bed secondary fluidic element.

The bed of the secondary fluidic element was treated prior to sample loading by conditioning the bed with 40 uL of methanol and spinning in the centrifuge at 2,000×g (5,000 rpm) for 15 seconds. This was followed by the addition of 10 uL of pure water and spinning again at 2,000×g (5,000 rpm) for 15 seconds. Two 40 μL aliquots of the sample mixture were loaded into the secondary fluidic element reservoir by pipette and spun in the centrifuge at 2,000×g (5,000 rpm) for 30 seconds. At this point, any chemical compounds present in the mixture, having sufficient hydrophobic character, will be chemically adsorbed to the surface of the packed bed C18 media.

The loaded secondary fluidic is then transferred to an assembly consisting of a second micro-centrifuge tube and a nanospray emitter assembly as previously described in example 1.

A 5 μL aliquot of extraction solvent consisting of 0.1% formic acid and 80% acetonitrile (by volume) was added to the secondary fluidic element reservoir. The assembly was then transferred to the centrifuge and again spun at a force of 2,000×g (5,000 rpm) for 15 seconds.

The assembly was then placed into the nanospray source apparatus operated identically as described in example 1. Full-scan mass spectrometric data was acquired for 5 minutes.

A reference sample of peptides at 1 pmol/uL in 80% acetonitrile and 0.1% formic acid, prepared identically as that of example 4, was subsequently loaded into the apparatus as described in example 1 to provide a reference signal for a non-SPE prepared sample. Full-scan mass spectrometric data was acquired for 5 minutes. Data analysis of the triply charged Angiotensin I molecular ion at 433 m/z was analyzed post acquisition to compare performance with the SPE and non-SPE processed samples. For the SPE processed sample a peak intensity and average intensity (30 second average) of $1.72\times10^7$ and $6.19\times10^6$ were observed. For the non-SPE processed sample, a peak intensity and average intensity (30 second average) of $8.6\times10^5$ and $2.86\times10^5$ were observed. This represents observed ratios of 19.9 and 21.6 fold for peak and average ion intensities respectively.

This result is greater than that expected for a system demonstrating 100% extraction and elution efficiency, which means that the invention yields a surprising effect whereby the effective elution volume is smaller than the total applied elution volume loaded into the device. The expected signal intensity, assuming 100% trapping and extraction efficiency, would yield an approximate 16-fold increase in ion intensity, representing the ratio of sample-to-elution volumes (80/5=16). The results are similar to that obtained if one were to reduce the actual applied volume of eluent by 1/20, from 5 μL to 0.25 uL. This is particularly advantageous since handling sub-microliter volumes with normal laboratory apparatus is considered either impractical or highly time-consuming and requiring expert practice. For extraction of miniaturized volumes (less than 10 uL) it is particularly advantageous to extract in the smallest practical volume.

Example 6

Alternate Validation of the Concentration Distribution

Example 3 was repeated as described with two substitutions: (A) the substitution of a colored dye solution replaced the peptide sample and (B) a nanospray emitter without a conductive coating was used to permit visual observation of the emitter's contents. Using a colored dye allows for the direct visual observation and photo-documentation of analyte concentration. The colored dye consisted of a 40 uL aliquot of FD&C BLUE 1 food coloring (McCormick & Co. Inc.) that had been previously diluted by 1000 fold in distilled water. The sample loading and elution operation was as described in example 3.

Immediately subsequent from elution of the sample into the nanospray emitter (2), the nanospray emitter (2) and nanospray emitter mount (1) were manually removed from the assembly (100) and placed under a conventional stereomicroscope (50× magnification) and digitally photographed using reflected light illumination. The digital photo was then analyzed with a quantitative image processing program (Image J from the National Institutes of Health; http://www.imagej.org). The program was used to measure the relative absorbance and the distribution of dye inside the nanospray emitter.

Figure 20:
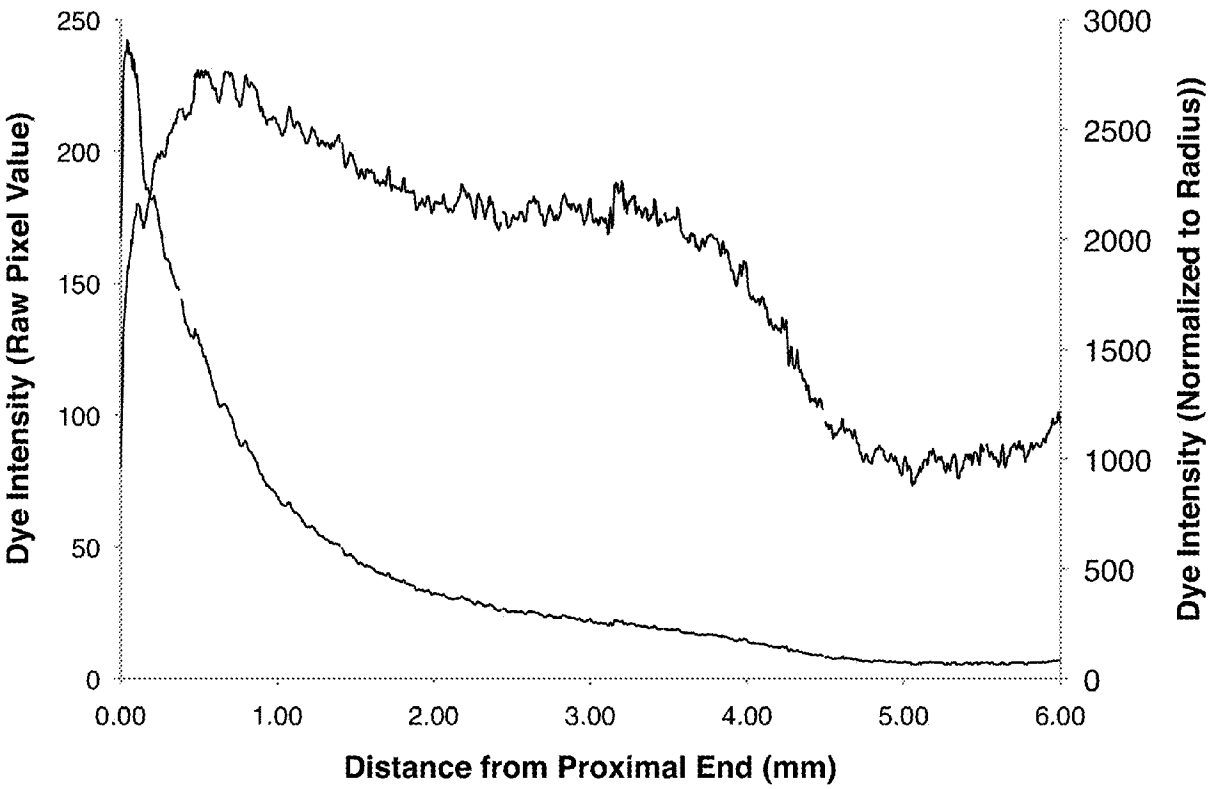
FIG. 20 shows the raw and normalized intensity distribution of a blue dye in relation to the proximal end of the nanospray emitter (23) as eluted from the SPE bed (4) as described in example 6.

The results of this analysis are shown in FIG. 20. The light line shows the raw pixel intensity representing the concentration of dye within the emitter. It was clearly observed that the distribution was non-uniform, and the concentration of dye increased closer to the proximal end (23) of the emitter (2). The actual concentration increase was then normalized (shown as the heavy line in FIG. 20) to the diameter of the emitter (2). Because the proximal end (23) was tapered with a cone angle of approximately 12 degrees, there was less of an optical path length for dye absorption the closer one is to the proximal end (23). Normalizing the raw intensity with the measured diameter of the emitter shows a response that is well correlated to the dye concentration. The peak normalized intensity, near the proximal end of the emitter, was 28 fold higher than the mean level of dye at a distance 5 mm away from the proximal end.

Note that the normalized peak intensity of dye is very similar to the distribution of peptide ion current obtained from example 3. Therefore a rational explanation of the increase in observed ion intensity is that the analyte has a non-uniform distribution within the nanospray emitter.

It is important that the desirable concentration distribution is preserved inside the nanospray emitter tube. The dimensions of the interior volume of the nanospray emitter with respect to the total elution volume is critical for preservation of the concentration gradient. As the emitter sits prior to analysis, diffusion will drive the contents of the emitter to a homogeneous distribution. In the examples presented here the inside diameter of the nanospray emitter was 1.2 mm at the distal end (22). At the proximal end (23) of the emitter the inside diameter tapered to a 2-4 μm orifice over a total length of approx. 4.5 mm with a cone angle typically between 12-14 degrees. Using a nanospray emitter that was both longer, and of a narrower inside diameter would improve the preservation of the concentration gradient over time. The effective use of a smaller elution volume would require a smaller ID nanospray tube, a longer taper region at the proximal end (23), or both, for effective use. A smaller diameter, and/or longer taper would also relax the need for immediate analysis by mass spectrometry since longitudinal diffusion inside the emitter tube would be reduced. A larger elution volume would not benefit from a larger ID nanospray tube however, since axial and longitudinal diffusion would be enhanced with inside diameters much greater than or equal to 2 mm.

The examples presented within all use a centrifuge to generate the forces for the transfer of liquid sample and eluent from the secondary fluidic element into the nanospray emitter. As is known to those skilled in the prior art of solid-phase extraction, other physical means of effecting the fluidic transfer are viable. These other methods include the use of a pressure differential (either high-pressure gas or vacuum or both) across the secondary fluidic element and/or nanospray emitter to induce flow.

The invention claimed is:

1. A method for isolation of a target compound from a solution thereof, and analysis of said target compound by nanospray ionization mass spectrometry, which comprises the steps of:

a) providing:

i) a cartridge having a fluid container with a cartridge inlet and a cartridge outlet, with a solid phase extraction bed of porous sorbent media covering or placed within the cartridge outlet, ii) a nanospray emitter tube having a distal end and a proximal end, iii) a nanospray emitter mount having a nanospray emitter mount inlet and a nanospray emitter mount outlet, said nanospray emitter mount inlet having a surrounding flange and said nanospray emitter mount outlet being adapted to receive and hold said nanospray emitter tube with the proximal end projecting through said nanospray emitter mount outlet and said distal end spaced away from the nanospray emitter mount inlet a distance that permits engagement of the cartridge outlet of said cartridge with the distal end of said nanospray emitter tube when said cartridge is mounted on said nanospray emitter mount, and iv) a micro-centrifuge tube having a tube inlet opening with a rim around the inlet opening said cartridge having a first flange, complimentary to the flange of said nanospray emitter mount, a second flange, complimentary to the rim of said micro-centrifuge tube, and said cartridge outlet of said cartridge being adapted to mate with the distal end of said nanospray emitter tube, with the inner surface of said cartridge outlet being tangential to the inner surface of said distal end of said nanospray emitter tube at at least one point, and provide non-turbulent flow of a solution of said target compound from said fluid container into said nanospray emitter tube when said cartridge is mounted on the nanospray emitter mount inlet of said nanospray emitter mount, with the cartridge outlet of said cartridge mating with said distal end of said nanospray emitter tube, to form a nanospray emitter assembly and said nanospray emitter assembly is mounted on a micro-centrifuge tube and spun in a centrifuge to force non-turbulent flow of said sample solution from said fluid container of said cartridge, through said cartridge outlet and into said nanospray emitter tube, b) installing said nanospray emitter tube in the outlet of said nanospray emitter mount with the proximal end of said nanospray emitter tube projecting through said outlet of said nanospray emitter mount and said distal end spaced away from the nanospray emitter mount inlet a distance that permits engagement of the cartridge outlet of said cartridge with the distal end of said nanospray emitter tube, c) mounting said cartridge on said micro-centrifuge tube, loading said solution of said target compound into the fluid container of said cartridge, placing said micro-centrifuge tube with the cartridge mounted thereon in a centrifuge and spinning said micro-centrifuge tube in said centrifuge to force said solution to flow through said porous media and into said micro-centrifuge tube, whereby said target compound is adsorbed by said porous media, d) removing said cartridge from said micro-centrifuge tube and installing it on the emitter tube mount inlet of said nanospray emitter tube mount with the nanospray emitter tube in place and engaging the cartridge outlet of said cartridge with the distal end of said nanospray emitter tube to form a nanospray emitter tube assembly, mounting said nanospray emitter tube assembly on an empty micro-centrifuge tube, loading a volume of an extraction solvent into said fluid container of said cartridge, said volume of extraction solvent being substantially less than the volume of said solution of said target compound that had been loaded into said fluid container in step c), and spinning said micro-centrifuge tube in said centrifuge to force a non-turbulent flow of said extraction solvent through said sorbent media to extract said target compound from said sorbent media and form a solution of said target compound in said extraction solvent and non-turbulent flow of said solution of said target compound in said extracton solvent into said nanospray emitter tube, e) engaging said nanospray emitter tube in a mass spectrometer applying sufficient voltage to said nanospray emitter tube to cause electrospray ionization to occur and analyzing said electrospray in said mass spectrometer.

2. A method of loading a sample of a target compound into a nanospray emitter tube for analysis by nanospray ionization mass spectrometry, which comprises the steps of:

a) providing:

i) a cartridge having a fluid container, with a cartridge inlet and a cartridge outlet, ii) a nanospray emitter tube having a distal end and a proximal end, mounted in a nanospray emitter tube mount having a nanospray emitter tube mount inlet and a nanospray emitter tube mount outlet, said nanospray emitter tube mount inlet having a surrounding flange and said nanospray emitter tube mount outlet holding said nanospray emitter tube with the proximal end projecting through said nanospray emitter tube mount outlet and said distal end projecting towards and being spaced away from the nanospray emitter tube mount inlet a distance that permits engagement of the cartridge outlet of said cartridge with the distal end of said nanospray emitter tube, with the inner surface of said cartridge outlet being tangential to the inner surface of said distal end of said nanospray emitter tube at at least one point, when said cartridge is mounted on said nanospray emitter tube mount, and iii) a micro-centrifuge tube having a micro-centrifuge tube inlet opening with a rim around the micro-centrifuge tube inlet opening, said cartridge having a first flange, complimentary to the flange of said nanospray emitter tube mount, a second flange, complimentary to the rim of said micro-centrifuge tube, and said cartridge outlet of said cartridge being adapted to mate with the distal end of said nanospray emitter tube, b) mounting said cartridge on the inlet of said nanospray emitter tube mount and engaging the cartridge outlet of said cartridge with the distal end of said nanospray emitter tube to form a nanospray emitter tube assembly, mounting said nanospray emitter tube assembly on an empty micro-centrifuge tube, loading a volume of a sample to be analyzed into said fluid container of said cartridge, and spinning said micro-centrifuge tube, with said nanospray emitter tube assembly mounted thereon, in said centrifuge to transfer said sample into said nanospray emitter tube, said engagement of said cartridge outlet with said distal end of said nanospray emitter thereby being adapted to preserve non-turbulent flow from said cartridge into said emitter tube, c) engaging said nanospray emitter tube in a mass spectrometer applying sufficient voltage to said nanospray emitter tube to cause electrospray ionization to occur and analyzing said electrospray in said mass spectrometer.

* * * * *